United States Patent [19]

Garwood et al.

[11] Patent Number: 4,564,440

[45] Date of Patent: Jan. 14, 1986

[54] VISCOSITY INDEX IMPROVEMENT IN DEWAXED LUBE BASESTOCK BY PARTIAL DESULFURIZATION IN HYDROTREAT BED

[75] Inventors: William E. Garwood, Haddonfield, N.J.; William C. Starr, Wilmington, Del.; John W. Walker, Sewell, N.J.

[73] Assignee: Mobil Oil Corporation, New York, N.Y.

[21] Appl. No.: 512,510

[22] Filed: Jul. 11, 1983

[51] Int. Cl.[4] ..... C10G 65/12; C10G 67/04

[52] U.S. Cl. ..... 208/87; 208/97; 208/216 R

[58] Field of Search ..... 208/87, 97

[56] References Cited

U.S. PATENT DOCUMENTS 3,702,817 11/1972 Cummins et al. ..... 208/87
3,894,938 7/1975 Gorring et al. ..... 208/97
3,989,617 11/1976 Yan ..... 208/87
4,181,598 1/1980 Gillespie et al. ..... 208/58
4,259,170 3/1981 Graham et al. ..... 208/33

FOREIGN PATENT DOCUMENTS 0101232 2/1984 European Pat. Off. .

*Primary Examiner*—D. E. Gantz
*Assistant Examiner*—O. Chaudhuri
*Attorney, Agent, or Firm*—Alexander J. McKillop; Michael G. Gilman; James F. Powers, Jr.

[57] ABSTRACT

Partial desulfurization in the range of about 30–90% during hydrotreating of a dewaxed lube oil basestock provides an increase in viscosity index of up to five numbers with less than about 5 wt. % yield loss, a consequence of the desulfurized compounds staying in the lube boiling range.

14 Claims, 4 Drawing Figures

CATALYST TEMPERATURE VS. VISCOSITY INDEX

LUBE YIELD VS. VISCOSITY INDEX

DESULFURIZATION VS. VISCOSITY INDEX

SUS @100°F VS. VISCOSITY INDEX

VISCOSITY INDEX IMPROVEMENT IN DEWAXED LUBE BASESTOCK BY PARTIAL DESULFURIZATION IN HYDROTREAT BED

BACKGROUND OF THE INVENTION

1. Field of the Invention

This invention is concerned with manufacture of high grade viscous oil products from crude petroleum fractions. It is particularly directed to the manufacture of high quality lube basestock oils from crude stocks of high wax content, commonly classified as "wax base" as compared with the "naphthenic base" crudes. The latter crudes are relatively lean in straight chain paraffins and yield viscous fractions which inherently possess low pour points. More specifically, the invention is concerned with improving the viscosity index of catalytically dewaxed lube basestock oils.

2. Description of the Prior Art

High quality lube basestock oils are conventionally prepared by refining distillate fractions or the residuum prepared by vacuum distilling a suitable crude oil from which the lighter portion has been removed by distillation in an atmospheric tower. Thus, the charge to the vacuum tower is commonly referred to as a "long residuum" and residuum from the vacuum tower is distinguished from the starting material by referring to it as the "short residuum".

The vacuum distillate fractions are upgraded by a sequence of unit operations, the first of which is solvent extraction with a solvent selective for aromatic hydrocarbons. This step serves to remove aromatic hydrocarbons of low viscosity index and provides a raffinate of improved viscosity index and quality. Various processes hve been used in this extraction stage, and these employ solvents such as furfural, phenol, sulfur dioxide, and others. The short residuum, because it contains most of the asphaltenes of the crude oil, is conventionally treated to remove these asphalt-like constituents prior to solvent extraction to increase the viscosity index.

The raffinate from the solvent extraction step contains paraffins which adversely effect the pour point. Thus, the waxy raffinate, regardless of whether prepared from a distillate fraction or from the short residuum, must be dewaxed. Various dewaxing procedures have been used, and the art has gone in the direction of treatment with a solvent such as methyl ethyl ketone/-toluene mixtures to remove the wax and prepare a dewaxed raffinate. The dewaxed raffinate may then be finished by any number of sorption or catalytic processes to improve color and oxidation stability.

The quality of the lube basestock oil prepared by the sequence of operations outlined above depends on the particular crude chosen as well as the severity of treatment for each of the treatment steps. Additionally, the yield of high quality lube basestock oil also depends on these factors, and as a rule, the higher quality sought, the less the yield. In general, naphthenic crudes are favored because less loss is encountered, particularly in the dewaxing step. In many cases, however, waxy crudes are more readily available, and it would be desirable to provide a process for preparing high quality lube basestock oils in good yields from such waxy crude oils.

In recent years techniques have become available for catalytic dewaxing of petroleum stocks. A process of that nature developed by British Petroleum is described in the Oil and Gas Journal dated Jan. 6, 1975, at pages 69–73. See also U.S. Pat. No. 3,668,113.

In U.S. Pat. No. Re. 28,398 is described a process for catalytic dewaxing with a catalyst comprising zeolite ZSM-5. Such process combined with catalytic hydrofinishing is described in U.S. Pat. No. 3,894,938 for reducing the pour point of a sulfur and nitrogen containing gas oil boiling within the range of 400°–900° F.

In U.S. Pat. No. 3,979,279 a stabilized lubricating oil stock resistant to oxidation and sludge formation upon exposure to a highly oxidated environment is formed by contacting a high viscosity lubricating oil stock with hydrogen in the presence of a catalyst of low acidity comprised of a platinum-group metal on a solid refractory inorganic oxide support.

A two-stage process for preparing a high quality lube basestock oil is disclosed in U.S. Pat. No. 4,181,598 in which a raffinate is mixed with hydrogen and the mixture contracted with a dewaxing catalyst comprising a ZSM-5 type catalyst to convert the wax contained in the raffinate to low boiling hydrocarbons and subsequently, contacting the dewaxed raffinate in the presence of hydrogen at a temperature of 425°–600° F. with a hydrotreating catalyst comprising a hydrogenation component on a non-acid support. Hydrotreating the dewaxed raffinate is limited to saturate olefins and reduce product color without causing appreciable desulfurization.

It has been found in a hydrofinishing optimization study that at higher temperatures above 500° F. oxidation stability as measured by RBOT declined, but that the viscosity index could be increased several numbers. Also, it has been discovered by the inventor's coworkers that high V.I. lubes can be manufactured from marginal crudes by successive furfural extraction, catalytic dewaxing, and hydrotreating over strong hydrogenation catalysts to desulfurize and crack the sulfur compounds to lower boiling product out of the lube range as disclosed in copending U.S. patent application Ser. No. 528,331 filed concurrently with the present application.

It is an object of this invention to provide a process for increasing the viscosity index of a catalytically dewaxed lube basestock oil under conditions which greatly reduce the sulfur content of the lube oil basestock without loss of lube yield.

Another object of the invention is to produce a high V.I. lube oil basestock from catalytically dewaxed lube fractions to a viscosity index comparable to that achieved by solvent dewaxing. Other objects will be evident to those skilled in the art upon reading the entire contents of this specification, including the claims thereof.

SUMMARY OF THE INVENTION

It has now been found that the viscosity index of lube obtained from catalytically hydrodewaxing hydrocarbon chargestocks having a boiling point of at least about 600° F. can be increased up to five numbers by partial desulfurization of the lube with less than 5 wt.% lube yield loss. This is accomplished by a sequential process comprising catalytically dewaxing a hydrocarbon fraction having an initial boiling point of at least about 600° F. and then subjecting at least a liquid product resulting from such dewaxing to partial desulfurization at a temperature in the range of about 625°–700° F. at a pressure of 200–700 psig in the presence of conventional hydrotreating catalysts. At temperatures below about 700° F. and at the above-defined pressures and space velocities presently used for catalytically dewaxing, the lube will be 30–90% desulfurized. Furthermore, the desulfurized sulfur compounds do not crack but stay in the lube boiling range, accounting for the complete lube recovery.

DESCRIPTION OF SPECIFIC EMBODIMENTS

Figure 1:
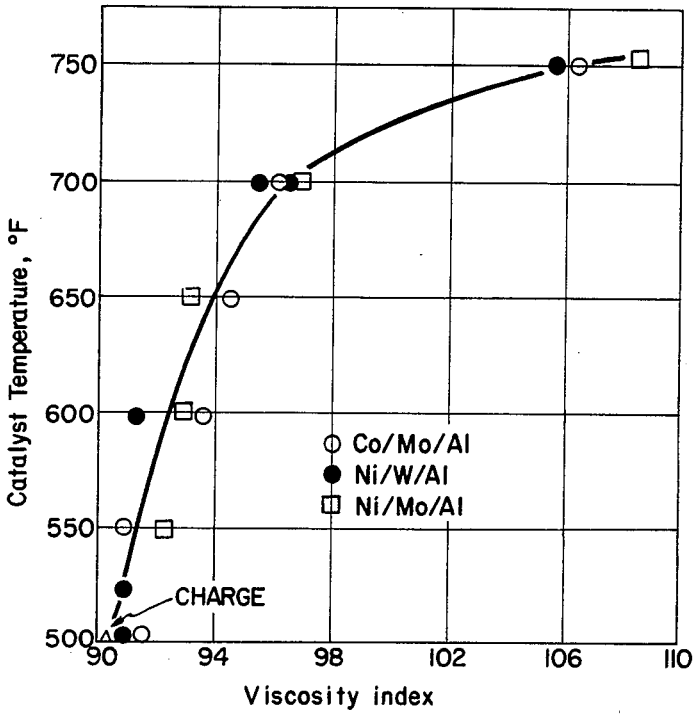
FIG. 1 is a graph of experimental data illustrating the effect of temperature in the hydrotreating stage on the viscosity index of the dewaxed lube.

The wax base crudes (sometimes called "paraffin base") from which the chargestock is derived by distillation constitute a well-recognized class of crude petroleums. Many scales have been devised for classification of crude, some of which are described in chapter VII, Evaluation of Oil Stocks of "Petroleum Refinery Engineering," W. L. Nelson, McGraw Hill, 1941. A convenient scale identified by Nelson at page 69 involves determination of the cloud point of the Bureau of Mines "Key fraction #2" which boils between 527° F. and 572° F. at 40 mm pressure. If the cloud point of this fraction is above 5° F., the crude is considered to wax base.

In practice of the present invention, a suitable chargestock such as a propane deasphalted short residuum fraction or a fraction having an initial boiling point of at least about 450° F., preferably at least about 600° F., and a final boiling point less than about 1100° F. is prepared by distillation of such wax base crude. Such fraction can then be solvent defined by counter current extraction with at least an equal volume (100 volume percent) of a selective solvent such as furfural. It is preferred to use about 1.5–3.0 volumes of solvent per volume of oil. The furfural raffinate is subjected to catalytic dewaxing by mixing with hydrogen and contacting at 500°–675° F. with a catalyst containing a hydrogenation metal and zeolite ZSM-5 or other related silicate zeolites having a silica/alumina ratio of at least 12 and a Constraint Index of 1–12 and a liquid hourly space velocity (LHSV) of 0.1–2.0 volumes of charge oil per volume of catalyst per hour. The preferred space velocity is 0.5–1.0 LHSV.

The effluent of catalytic dewaxing is then cascaded into a hydrotreater containing, as catalysts, a hydrogenation component on a non-acid support, such as cobalt-molybdate, nickel-molybdate or nickel-tungsten on alumina. The hydrotreater operates at a temperature range higher than that presently used during the hydrotreating of dewaxed basestocks, such as disclosed in U.S. Pat. No. 4,181,598. Typically, the hydrotreater has operated at temperatures of 425°–600° F. to saturated olefins and to reduce product color, without causing appreciable desulfurization of the dewaxed lube. In accordance with the present invention, the temperature and pressure in the hydrotreater are adjusted to partially desulfurize the catalytically dewaxed effluent. At temperatures above 600° F. and up to 700° F., and pressures of 200–700 psig and space velocities typically used for catalytic dewaxing, the dewaxed effluent will be from about 30 to about 90 percent desulfurized. In addition, at such conditions the desulfurized sulfur compounds in the effluent do not crack, but stay in the lube boiling range, accounting for complete lube recovery, i.e., less than 5 wt.% loss and in some cases less than 1% loss. The viscosity index of the lube upon desulfurization in accordance with the present invention is substantially increased, such that the viscosity index of the lubes prepared in accordance with the present invention are comparable to that achieved by solvent dewaxing. Improvements in viscosity index up to five numbers have been achieved without yield loss.

Dewaxing is carried out at a hydrogen partial pressure of 150–1500 psia, at the reactor inlet, and preferably at 250–500 psia. Dewaxing and hydrotreating operate at 500 to 5000 standard cubic feet of hydrogen per barrel of feed (SCF/B), preferably 1500 to 2500 SCF/B. For efficient operation it is preferred to run the dewaxing and hydrotreating reactors at the same pressure, i.e. 200–700 psig.

The catalyst employed in the catalytic dewaxing reactor and the temperature in that reactor are important to success in obtaining good yields and very low pour point product. The hydrotreater catalyst may be any of the catalyst commercially available for that purpose but the temperature would be held within narrow limits for best results.

The solvent extraction technique is well understood in the art and needs no detail review here. The severity of extraction is adjusted to composition of the chargestock to meet specifications for the particular lube basestock and the contemplated end use; this severity will be determined in practice of this invention in accordance with well established practices.

The catalytic dewaxing step is conducted at temperatures of 500°–675° F. At temperatures above about 675° F., bromine number of the product generally increases significantly and the oxidation stability decreases.

The dewaxing catalyst is a composite of hydrogenation metal, preferably a metal of Group VIII of the Periodic Table, associated with the acid form of a novel class of aluminosilicate zeolite having a silica/alumina ratio of at least about 12 and a Constraint Index of 1 to 12. Such zeolites are characterized as being part of the ZSM-5 family.

The class of zeolites useful herein is exemplified by ZSM-5, ZSM-11, ZSM-12, ZSM-23, ZSM-35, ZSM-38 and other similar materials. U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference.

Natural zeolites may sometimes be converted to this type zeolite catalyst by various activation procedures and other treatments such as base exchange, steaming, alumina extraction and calcination, in combinations. Natural minerals which may be so treated include ferrierite, brewsterite, stilbite, dachiardite, epistilbite, heulandite, and clinoptilolite. The preferred crystalline aluminosilicates are ZSM-5, ZSM-11, ZSM-12, ZSM-23, ZSM-35 and ZSM-38, with ZSM-5 particularly preferred.

In practicing the desired conversion process, it may be desirable to incorporate the above-described crystalline aluminosilicate zeolite in another material resistant to the temperature and other conditions employed in the process. Such matrix materials include synthetic or naturally occurring substances as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-beryllia, silica-titania as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix may vary widely with the zeolite content ranging from between about 1 to about 99 percent by weight and more usually in the range of about 5 to about 80 percent by weight of the composite.

In the process of this invention, the total effluent of the catalytic dewaxing step, including the hydrogen, is cascaded into a hydrotreating reactor of the type now generally employed for finishing of lubricating oil stocks. In this "cascade" mode of operation, the hydrotreater is sized to handle the total dewaxer effluent. Although some modification of the cascade operation is contemplated, such as interstage recovery of gasoline boiling range by-product, it is to be understood that such modification contemplates no substantial interruption or substantial delay in passing the dewaxed raffinate to the hydrotreater. Thus, "cascading", as used herein, means passing the dewaxed raffinate plus hydrogen to hydrotreating without storage to the dewaxer effluent.

Any of the known hydrotreating catalysts consisting of a hydrogenation component of a non-acid support may be employed in the hydrotreating step. Such catalysts include, for example, cobalt-molybdate, nickel-molybdate, or nickel-tungsten on an alumina support. Here again, temperature and pressure control are required for the desired desulfurization and consequent production of high quality, high V.I. product, the hydrotreater being operated at temperatures over 600° F. to about 700° F. and pressures of from 200–700 psig.

The effluent of the hydrotreater is topped by distillation, i.e., the most volatile components are removed, to meet flash and firepoint specifications.

The following Examples are given as illustrative of this invention and are not to be construed as limiting thereon except as defined by the claims. In the Examples, all parts are given by weight unless specified otherwise.

EXAMPLE 1

A chargestock comprising a hydrodewaxed oil having the properties set forth in Table 1 was used to evaluate the effect of temperature during hydrotreating and thus the degree of desulfurization of the viscosity index of the dewaxed oil. Three commercial catalysts were compared, a Co/Mo/Al catalyst (Harshaw HT-400, containing 2.8 wt.% CoO and 9 wt.% $MoO_3$); a Ni/W/Al catalyst (Shell 354, 2.9 wt.% Ni, 26.7 wt.% W, 0.08 wt.% $MoO_3$) and a Ni/Mo/Al catalyst (American Cyanamid HDN 30, 3.5 wt.% Ni and 20.0 wt.% $MoO_3$). The dewaxed oil was passed over the catalysts at 400 psig, 1 LHSV, and about 2500 SCF/bbl, over a temperature range of 500°–750° F. Detailed data on the 12 day run with Co/Mo/Al and the 17 day run with Ni/W/Al and the 6½ day run with Ni/Mo/Al are listed in Tables 1, 2 and 3, respectively.

TABLE 1

RUN DATA, Co/Mo/Al[1]
Conditions - 400 psig, 1 LHSV, 2500 SCF $H_2$/bbl

| Run No. | | −1 | −2 | −3 | −4 | −5 | −6 | −7 | −8 | −9 |
|---|---|---|---|---|---|---|---|---|---|---|
| Time on Stream, Days | CHARGE | 0.8 | 1.6 | 3.6 | 5.5 | 6.5 | 7.4 | 8.4 | 11.1 | 12.0 |
| Temperature, °F., Average | | 499 | 499 | 550 | 600 | 651 | 700 | 751 | 698 | 700 |
| Maximum | | 501 | 501 | 551 | 602 | 652 | 702 | 752 | 701 | 701 |
| Run Time, hrs | | 19 | 20 | 47 | 47½ | 23 | 23 | 23 | 64 | 23 |
| Liquid Product Gravity, °API | 26.4 | 27.9 | 27.7 | 28.0 | 28.2 | 28.3 | 29.2 | 31.4 | 29.3 | 29.4 |
| Material Balance, wt % | | 99.4 | 98.9 | 101.3 | 100.5 | 99.0 | 100.5 | 101.6 | 99.8 | 100.1 |
| Yields, wt % (NLB) | | | | | | | | | | |
| $C_1+C_2$ | | <0.1 | <0.1 | <0.1 | 0.1 | <0.1 | 0.1 | 0.4 | 0.2 | 0.1 |
| $C_3$ | | <0.1 | <0.1 | <0.1 | 0.1 | <0.1 | 0.1 | 0.3 | 0.1 | 0.3 |
| $C_4$ | | <0.1 | <0.1 | <0.1 | <0.1 | <0.1 | 0.1 | 0.3 | 0.2 | <0.1 |
| $C_5$ | | <0.1 | <0.1 | <0.1 | <0.1 | <0.1 | <0.1 | 0.1 | 0.1 | 0.1 |
| $C_6$ -650° F. | | <0.1 | <0.1 | <0.1 | <0.1 | <0.1 | 2.4 | 16.1 | 98.7 | 2.1 |
| 650° F.+ Lube | 100.0 | 99.7 | 99.7 | 99.5 | 99.3 | 99.5 | 96.7 | 81.7 | | 96.8 |
| $H_2S$ | | 0.2 | 0.2 | 0.4 | 0.6 | 0.7 | 0.8 | 0.8 | 0.8 | 0.8 |
| TOTAL | | 99.9 | 99.9 | 99.9 | 100.1 | 100.2 | 100.2 | 99.7 | 100.2 | 100.2 |
| Hydrogen Cons., SCF/bbl | | −60 | −50 | −25 | 40 | 115 | 105 | −180 | 95 | 100 |
| 650° F.+ Lube Properties | | | | | | | | | | |
| Gravity, °API | 26.4 | 27.9[2] | 27.7[2] | 28.0[2] | 28.2[2] | 28.3[2] | 28.2 | 30.2 | — | 30.2 |
| Specific | 0.8961 | 0.8877 | 0.8888 | 0.8871 | 0.8860 | 0.8855 | 0.8860 | 0.8805 | — | 0.8811 |
| Pour Point, °F. | +15 | +10 | 0 | +10 | +5 | +10 | +15 | +15 | — | +20 |

TABLE 1-continued

RUN DATA, Co/Mo/Al[1]

Conditions - 400 psig, 1 LHSV, 2500 SCF $H_2$/bbl

| Run No. | | −1 | −2 | −3 | −4 | −5 | −6 | | −7 | | −8 | | −9 |
|---|---|---|---|---|---|---|---|---|---|---|---|---|---|
| KV @ 40° C., cs. | 128.8 | 120.6 | 123.6 | 120.6 | 114.9 | 107.5 | 98.40 | | 62.80 | | — | | 98.15 |
| KV @ 100° C., cs. | 12.78 | 12.37 | 12.55 | 12.34 | 12.06 | 11.59 | 11.02 | | 8.52 | | — | | 11.00 |
| SUS @ 100° F. | 677 | 632 | 649 | 633 | 602 | 562 | 514 | | 325 | | — | | 512 |
| SUS @ 210° F. | 70.4 | 69.2 | 69.9 | 69.1 | 68.0 | 66.1 | 64.0 | | 54.9 | | — | | 63.9 |
| Viscosity Index | 90.3 | 92.3 | 92.0 | 91.9 | 93.6 | 94.5 | 96.2 | | 106.6 | | — | | 96.2 |
| Sulfur, wt %[2] | 0.81 | 0.58 | 0.66 | 0.46 | 0.26 | 0.12 | 0.056 | | 0.032 | | 0.056 | | 0.064 |
| Nitrogen, ppm | 61 | — | — | — | — | 47 | 28 | | 10 | | — | | 29 |
| Bromine No. | 0.30 | — | — | — | — | 0.10 | 0.60 | | 0.40 | | — | | 0.20 |
| Boiling Range, °F. | | | | | | | | | | | | | |
| 1% | 639 | 623 | 624 | 639 | 624 | 611 | 467[2] | 660 | 230[2] | 662 | 457[2] | 470 | 657 |
| 5 | 763 | 759 | 753 | 776 | 766 | 760 | 674 | 759 | 416 | 713 | 668 | 673 | 755 |
| 10 | 828 | 821 | 816 | 832 | 824 | 821 | 768 | 840 | 541 | 758 | 765 | 767 | 835 |
| 30 | 911 | 917 | 918 | 915 | 911 | 910 | 898 | 956 | 787 | 916 | 896 | 897 | 956 |
| 50 | 948 | 958 | 960 | 953 | 950 | 951 | 946 | 986 | 896 | 975 | 943 | 944 | 987 |
| 70 | 982 | 996 | 997 | 987 | 985 | 985 | — | 1004 | — | 995 | — | — | 1003 |
| 90 | 1024 | 1041 | 1041 | 1032 | 1032 | 1030 | — | 1029 | — | 1022 | — | — | 1027 |
| 95 | 1050 | 1070 | 1070 | 1059 | 1061 | 1056 | — | 1042 | — | 1034 | — | — | 1040 |

[1]Harshaw HT 400

[2]Total Liquid Product Properties.

TABLE 2

RUN DATA, Ni/W/Al[1]

Conditions - 400 psig, 1 LHSV, 2500 SCF $H_2$/bbl

| Run No. | | −1 | −2 | −3 | −4 | −5 | −6 | −7 | −8 | −9 | −10 | −11 | −12 |
|---|---|---|---|---|---|---|---|---|---|---|---|---|---|
| Time on Stream, Days | CHARGE | 0.7 | 3.3 | 4.3 | 5.2 | 6.1 | 7.0 | 9.9 | 10.9 | 11.7 | 12.6 | 15.7 | 16.6 |
| Temperature, °F., Average | | 500 | 500 | 500 | 525 | 551 | 600 | 651 | 651 | 699 | 750 | 700 | 700 |
| Maximum | | 501 | 501 | 501 | 526 | 552 | 601 | 652 | 653 | 702 | 752 | 702 | 702 |
| Run Time, hrs | | 17½ | 62 | 23½ | 20½ | 22½ | 22½ | 70½ | 25 | 19 | 22½ | 75 | 20½ |
| Liquid Product Gravity, °API | 26.4 | 27.3 | 27.4 | 27.6 | 27.5 | 27.5 | 27.9 | 28.8 | 28.6 | 29.0 | 31.0 | 29.1 | 29.2 |
| Material Balance, wt % | | 100.0 | 98.2 | 99.9 | 99.8 | 99.8 | 99.6 | 100.6 | 100.7 | 100.8 | 101.4 | 99.9 | 100.4 |
| Yields, wt % (NLB) | | | | | | | | | | | | | |
| $C_1+C_2$ | | <0.1 | <0.1 | <0.1 | <0.1 | <0.1 | <0.1 | <0.1 | 0.1 | 0.1 | 0.5 | 0.1 | 0.1 |
| $C_3$ | | 0.1 | <0.1 | <0.1 | <0.1 | <0.1 | <0.1 | <0.1 | 0.1 | 0.2 | 0.4 | 0.2 | 0.2 |
| $C_4$ | | 0.1 | <0.1 | <0.1 | <0.1 | <0.1 | <0.1 | <0.1 | <0.1 | 0.1 | 0.3 | 0.2 | 0.2 |
| $C_5$ | | 0.1 | <0.1 | <0.1 | 0.1 | <0.1 | <0.1 | <0.1 | <0.1 | <0.1 | 0.4 | <0.1 | <0.1 |
| $C_6$-650° F. | | <0.1 | <0.1 | <0.1 | <0.1 | <0.1 | <0.1 | <0.1 | <0.1 | 2.0 | 16.9 | 98.8 | 3.8 |
| 650° F.+ Lube | 100.0 | 99.7 | 100.0 | 100.0 | 99.8 | 99.7 | 99.6 | 99.3 | 99.2 | 96.8 | 80.7 | | 95.1 |
| $H_2S$ | | <0.1 | <0.1 | <0.1 | 0.1 | 0.3 | 0.4 | 0.7 | 0.7 | 0.8 | 0.8 | 0.8 | 0.8 |
| TOTAL | | 100.0 | 100.0 | 100.0 | 100.0 | 100.0 | 100.0 | 100.0 | 100.1 | 100.0 | 100.0 | 100.1 | 100.2 |
| Hydrogen Cons., SCF/bbl | | — | — | — | — | — | — | — | 75 | 20 | 10 | 70 | 110 |
| 650° F.+ Lube Properties | | | | | | | | | | | | | |
| Gravity, °API | 26.4 | 27.3[2] | 27.4[2] | 27.6[2] | 27.5[2] | 27.5[2] | 27.9[2] | 28.8[2] | — | 28.6 | 27.9 | — | 28.4 |
| Specific | 0.8961 | 0.8911 | 0.8905 | 0.8894 | 0.8899 | 0.8899 | 0.8877 | 0.8827 | — | 0.8838 | 0.8877 | — | 0.8849 |
| Pour Point, °F. | +15 | — | +5 | — | — | — | — | — | — | +15 | +20 | — | +15 |
| KV @ 40° C., cs. | 128.8 | 115.9 | 123.2 | 126.0 | 125.1 | 118.4 | 122.8 | 106.2 | — | 96.13 | 65.25 | — | 101.5 |
| KV @ 100° C., cs. | 12.78 | 12.09 | 12.47 | 12.64 | 12.59 | 12.20 | 12.45 | 11.50 | — | 10.87 | 8.71 | — | 11.21 |
| SUS @ 100° F. | 677 | 607 | 647 | 662 | 657 | 621 | 644 | 555 | — | 501 | 337 | — | 530 |
| SUS @ 210° F. | 70.4 | 68.1 | 69.6 | 70.2 | 70 | 68.5 | 69.5 | 65.8 | — | 63.4 | 55.6 | — | 64.7 |
| Viscosity Index | 90.3 | 93.0 | 91.2 | 91.0 | 91.1 | 92.4 | 91.3 | 94.6 | — | 96.6 | 105.7 | — | 95.5 |
| Sulfur, wt %[2] | 0.81 | 0.80 | 0.80 | 0.81 | 0.74 | 0.485 | 0.415 | 0.165 | 0.150 | 0.062 | 0.028 | 0.058 | 0.058 |
| Nitrogen, ppm | 61 | — | — | — | — | — | — | 44 | — | 23 | 7 | — | 19 |
| Bromine No. | 0.30 | — | — | — | — | — | — | 0.20 | — | 0.20 | 0.40 | — | 0.20 |
| Boiling Range, °F. | | | | | | | | | | | | | |
| 1% | 639 | 574 | 644 | 652 | 646 | 627 | — | 625 | 609 | 389[2] 654 | 269[2] 684 | 433 | 466[2] 632 |
| 5 | 763 | 794 | 808 | 805 | 796 | 751 | — | 770 | 738 | 667 747 | 396 731 | 646 | 666 737 |
| 10 | 828 | 865 | 871 | 869 | 853 | 812 | — | 835 | 807 | 765 820 | 503 773 | 754 | 770 799 |
| 30 | 911 | 935 | 936 | 937 | 930 | 908 | — | 927 | 905 | 895 948 | 736 921 | 891 | 894 910 |
| 50 | 948 | 968 | 969 | 970 | 965 | 947 | — | 963 | 944 | 937 982 | 877 977 | 935 | 936 953 |
| 70 | 982 | 1002 | 1003 | 1004 | 1001 | 982 | — | 998 | 979 | 972 1001 | 940 996 | 971 | 971 990 |
| 90 | 1024 | 1051 | 1051 | 1053 | 1051 | 1025 | — | 1042 | 1023 | 1017 1027 | 999 1022 | 1016 | 1016 1035 |
| 95 | 1050 | 1081 | 1081 | 1083 | 1082 | 1051 | — | 1072 | 1049 | 1041 1040 | 1020 1034 | 1039 | 1039 1063 |

[1]Shell 345

[2]Total Liquid Product Properties.

TABLE 3

Run Data, Ni/Mo/Al[1]
Conditions - 400 psig, 1 LHSV, 2500 SCF $H_2$/bbl

| Run No. | | −1 | −2 | −3 | −4 | −5 | −6 | −7 |
|---|---|---|---|---|---|---|---|---|
| Time on Stream, Days | Charge | 0.9 | 1.8 | 2.8 | 3.7 | 4.6 | 5.5 | 6.5 |
| Temp., °F., Average | | 502 | 502 | 550 | 601 | 651 | 701 | 751 |
| Maximum | | 502 | 502 | 551 | 602 | 652 | 702 | 752 |
| Run Time, Hrs | | 22 | 22 | 22½ | 22½ | 22½ | 22½ | 22½ |
| Liquid Product Gravity, °API | 26.4 | 27.5 | 27.4 | 27.3 | 27.8 | 28.2 | 29.0 | 30.9 |
| Material Balance, Wt % | | 100.3 | 100.8 | 101.3 | 102.0 | 101.4 | 101.6 | 102.4 |
| Yields, Wt % | | | | | | | | |
| $C_1+C_2$ | | <0.1 | <0.1 | <0.1 | 0.1 | <0.1 | 0.1 | 0.6 |
| $C_3$ | | 0.1 | 0.2 | 0.1 | 0.1 | 0.1 | 0.3 | 0.1 |
| $C_4$ | | <0.1 | 0.1 | 0.1 | <0.1 | <0.1 | <0.1 | <0.1 |
| $C_5$ | | 0.4 | <0.1 | 0.2 | 0.7 | 0.3 | <0.1 | 0.9 |
| $C_6$ -650° F. | | 0.1 | 0.1 | 0.1 | <0.1 | 0.2 | 1.4 | 11.9 |
| 650° F.+ Lube | 100.0 | 99.8 | 99.8 | 99.7 | 99.2 | 99.0 | 97.8 | 85.9 |
| $H_2S$ | | 0.1 | 0.1 | 0.1 | 0.3 | 0.6 | 0.8 | 0.8 |
| Total | | 100.4 | 100.3 | 100.3 | 100.4 | 100.2 | 100.4 | 100.2 |
| Hydrogen Consumption, SCF/bbl | | 260 | 170 | 200 | 245 | 115 | 255 | 115 |
| 650° F.+ Lube Properties | | | | | | | | |
| Gravity, °API | 26.4 | 27.4 | 27.2 | 27.3 | 27.5 | 28.1 | 28.6 | 28.8 |
| Specific | 0.8961 | 0.8905 | 0.8916 | 0.8911 | 0.8899 | 0.8866 | 0.8838 | 0.8827 |
| Pour Point, °F. | +15 | +15 | +5 | +15 | +20 | +15 | +20 | +20 |
| KV @ 40° C., cs | 128.8 | 118.8 | 126.9 | 123.8 | 120.4 | 113.4 | 92.92 | 52.68 |
| KV @ 100° C., cs | 12.78 | 12.19 | 12.68 | 12.59 | 12.40 | 11.93 | 10.65 | 7.64 |
| SUS @ 100° F. | 677 | 623 | 666 | 649 | 631 | 594 | 484 | 271 |
| SUS @ 210° F. | 70.4 | 68.5 | 70.4 | 70.0 | 69.3 | 67.5 | 62.6 | 51.8 |
| Viscosity Index | 90.3 | 91.5 | 90.7 | 92.4 | 93.0 | 93.2 | 97.1 | 108.7 |
| Sulfur, Wt %[2] | 0.81 | 0.74 | 0.77 | 0.69 | 0.495 | 0.24 | 0.08 | 0.016 |
| Nitrogen, ppm | 61 | — | — | — | — | — | — | 8 |
| Bromine No. | 0.30 | — | — | — | — | — | — | 0.8 |

[1]American Cyanamid HDN 30.
[2]Liquid product analysis.

The comparative runs were started at 500° F., and temperature was increased in 50° F. increments to 750° F. At temperatures above 650° F. with either catalyst, topping was necessary to remove lower boiling products.

FIGS. 1–4 are based on the experimental data taken from the comparative runs.

Referring to FIG. 1, it can be seen at 500°–600° F., V.I. increases only two numbers to about 92. At 600°–700° F. the increase in viscosity index is 2–6 numbers, the 700° F. result matching that than can be obtained by solvent dewaxing. At temperatures above 700° F., viscosity index increases substantially but at the expense of considerable loss of yield due to cracking.

Figure 2:
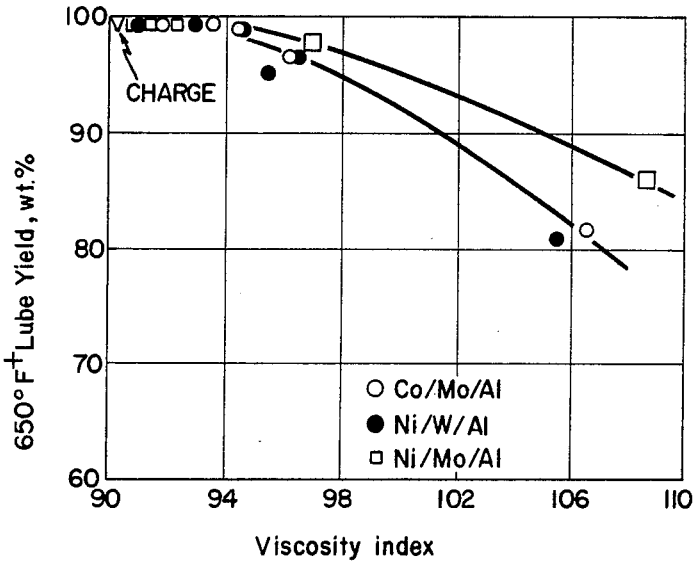
FIG. 2 is a graph of experimental data illustrating lube yield after hydrotreating versus viscosity index of the lube product.
Figure 3:
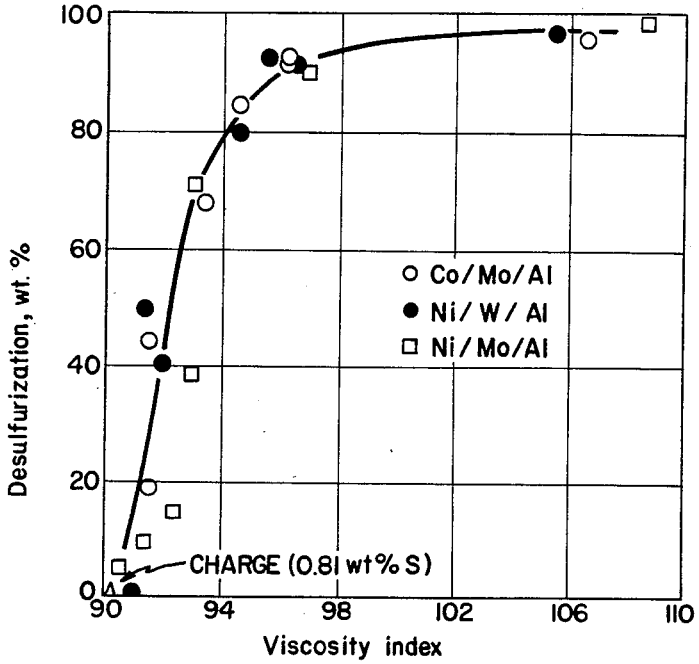
FIG. 3 is a graph of experimental data comparing the degree of desulfurization and viscosity index of the dewaxed lube product.

Referring to FIG. 2, lube yields are greater than 99 wt.% (100 volume percent) at viscosity indexes up to 94. Yield drops off appreciably at viscosity index above 95.

Desulfurization at 92 V.I. is about 30 wt.% and at 95 V.I. 85 wt.%. Higher desulfurization is undesirable because of yield loss shown in FIG. 2. All the data taken together indicate that this moderate V.I. increase from 90–94 is due to selective removal of the sulfur atoms from the sulfur molecules, with the desulfurized sulfur compounds staying in the lube oil boiling range. At more severe conditions, in this case, higher temperature, cracking occurs. Again, all the data taken together indicate that the desulfurized sulfur molecules, rather than higher V.I. components such as isoparaffins and naphthenes, are cracking to lower the boiling product out of the lube oil range. The low hydrogen consumptions of less than 100 SCF/bbl minimize aromatic hydrogenation as a factor contributing to the higher viscosity index.

Figure 4:
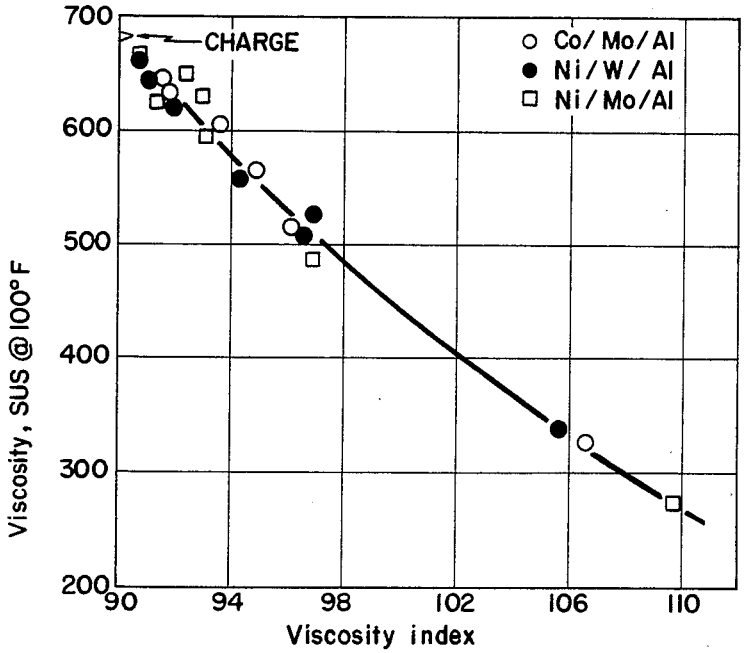
FIG. 4 is a graph of experimental data illustrating the effect that the viscosity of the charge has on the viscosity index of the hydrotreated dewaxed lube.

As shown in FIG. 4, the viscosity decreases with increasing the viscosity index. Some viscosity loss is not undesirable since the lower viscosities give less friction loss in engines. FIG. 4 shows that 94 V.I., SUS at 100° F. has decreased from 680 to 600. In general, the products from catalytic dewaxing are higher in viscosity than those obtained from solvent dewaxing. This difference can thus be balanced with the degree of desulfurization and viscosity index increase.

Data from Tables 1–3 also show that pour point is essentially unaffected (+15° F.±5° F.) over the range of temperature from 600°–700° F. and bromine numbers stay less than 1. Also, nitrogen content is lowered. Thus at partial desulfurization of 80%, nitrogen content is 47 ppm compared to 61 ppm for the charge. Both of the latter results should not adversely affect stability properties of the lube. However, adjustments to the additive package needed to compensate for the lower sulfur content of the final oils may be required.

EXAMPLE 2

A heavy neutral charge was extracted with furfural and the waxy raffinate obtained had the properties shown in Table 4 below.

TABLE 4

| Properties of Raffinate | |
|---|---|
| Gravity, °API | 28.1 |
| Specific | 0.8866 |
| Pour Point, °F. | 120 |
| KV at 100° C., cs | 10.77 |
| SUS at 210° F. (calc.) | 63 |
| Sulfur, wt. % | 0.96 |
| Nitrogen, ppm | 75 |
| Boiling Range, °F. | |
| IBP | 692 |
| 5% | 826 |
| 10 | 870 |
| 30 | 932 |
| 50 | 906 |
| 70 | 1000 |
| 90 | 1043 |

TABLE 4-continued

| Properties of Raffinate | |
|---|---|
| 95 | 1064 |

The stock was charged to a catalytic dewaxing plant with Ni/ZSM-5 in the first reactor (dewaxing stage) and Co/Mo/Al in the second reactor (hydrotreat stage). Conditions in each reactor were 400 psig, 1 LHSV, and 2500 $SCFH_2$/bbl. Temperature was adjusted in the dewaxing reactor to obtain a target pour point of +20° F. (550° F. start of cycle to 675° F. end of cycle), and temperature set successively in the hydrotreat reactor at 550° F., 650° F., and 715° F., with results as follows compared with typical solvent dewaxing.

TABLE 5

| Hydrotreat Temp., °F. | 550 | 650 | 715 | Typical Solvent Dewaxing |
|---|---|---|---|---|
| Yields, wt. % | | | | |
| $C_1$-$C_3$ | 3.3 | 3.3 | 4.6 | — |
| $C_4$ | 5.3 | 5.0 | 2.7 | — |
| $C_5$ | 3.4 | 4.0 | 3.2 | — |
| $C_6$–650° F. | 7.3 | 8.4 | 13.6 | — |
| 650° F.+ Lube | 80.8 | 79.3 | 72.8 | 72 |
| 650° F.+ Lube Properties | | | | |
| Gravity, °API | 27.0 | 27.5 | 28.3 | 26.8 |
| Specific | 0.8927 | 0.8899 | 0.8855 | 0.8939 |
| Pour Point, °F. | 30 | 30 | 30 | 20 |
| KV at 40° C., cs | 127.4 | 114.0 | 90.3 | 120.5 |
| KV at 100° C., cs | 12.77 | 12.09 | 10.53 | 12.5 |
| SUS at 212° F. (calc.) | 70.7 | 68.1 | 62.1 | 69.3 |
| Viscosity Index | 91.5 | 95.0 | 98.6 | 95 |
| Sulfur, wt. % | 0.72 | 0.165 | 0.058 | — |
| Nitrogen, ppm | 67 | 69 | 44 | — |
| Boiling Range, °F. | | | | |
| IBP | — | 616 | 619 | — |
| 5% | — | 790 | 731 | — |
| 30 | — | 849 | 790 | — |
| 50 | — | 95 | 939 | — |
| 70 | — | 986 | 971 | — |
| 90 | — | 1021 | 1043 | — |

Plots of hydrotreat temperature, weight percent desulfurization, lube yield and viscosity versus viscosity index check very closely with FIGS. 1–4 obtained from Example 1 above.

The 650° F.+ lubes produced at hydrotreat temperatures of 650° F. and 715° F. were topped to match the 210° F. viscosity of 95 viscosity solvent dewaxed oil. Viscosity index of the 94 V.I. lube produced at 650° F. was unaffected by topping up to about 6% of the total lube. Thus, catalytic dewaxing of the heavy neutral lube provides a yield advantage over solvent dewaxing at the same viscosity.

EXAMPLE 3

A similar set of experiments as that set forth in Example 2 above was made utilizing a light neutral charge having the properties as set forth in Table 6.

TABLE 6

| | |
|---|---|
| Gravity, °API | 30.5 |
| Specific | 0.8735 |
| Pour Point, °F. | 100 |
| KV at 100° C., cs | 5.66 |
| SUS at 210° F. (calc.) | 45.2 |
| Sulfur, wt. % | 0.89 |
| Nitrogen, ppm | 51 |
| Boiling Range, °F. | |
| IBP | 651 |

TABLE 6-continued

| | |
|---|---|
| 5% | 735 |
| 10 | 758 |
| 30 | 804 |
| 50 | 844 |
| 70 | 880 |
| 90 | 924 |
| 95 | 944 |

Hydrotreat temperatures were set at 515° F., 650° F., and 715° F., pressure was maintained at 400 psig with the following results compared with typical solvent dewaxing shown in Table 7.

TABLE 6

| Hydrotreat Temp., °F. | 515 | 650 | 715 | Typical Solvent Dewaxing |
|---|---|---|---|---|
| Yields, wt. % | | | | |
| $C_1$-$C_3$ | — | 2.7 | 2.4 | — |
| $C_4$ | — | 6.1 | 5.6 | — |
| $C_5$ | — | 6.9 | 7.2 | — |
| $C_6$–650° F. | — | 11.3 | 14.1 | — |
| 650° F.+ Lube | 77 | 73.0 | 70.7 | 77 |
| 650° F.+ Lube Properties | | | | |
| Gravity, °API | 28.2 | 29.3 | 29.4 | 29.0 |
| Specific | 0.8860 | 0.8800 | 0.8789 | 0.8816 |
| Pour Point, °F. | 15 | 10 | 15 | 20 |
| KV at 40° C., cs | 46.0 | 41.56 | 37.08 | 38.7 |
| KV at 100° C., cs | 6.57 | 6.20 | 5.85 | 6.12 |
| SUS at 100° F. (calc.) | 238 | 215 | 191 | 200 |
| SUS at 210° F. (calc.) | 48.3 | 47.0 | 45.9 | 46.7 |
| Viscosity Index | 91.6 | 93.5 | 98.5 | 103 |
| Sulfur, wt. % | 0.82 | 0.155 | 0.022 | — |
| Nitrogen, ppm | 57 | 45 | 21 | — |
| Boiling Range, °F. | | | | |
| IBP | — | 634 | 620 | — |
| 5% | — | 713 | 711 | — |
| 10 | — | 740 | 738 | — |
| 30 | — | 799 | 796 | — |
| 50 | — | 835 | 832 | — |
| 70 | — | 871 | 868 | — |
| 90 | — | 913 | 911 | — |
| 95 | — | 930 | 928 | — |

This lighter lubestock responded to the higher temperature hydrotreat in the same manner as the higher viscosity stock used in Example 2, but even at essentially complete desulfurization did not reach the 103 V.I. attained by solvent dewaxing. In addition, yield by catalytic dewaxing is lower than by solvent dewaxing, and topping of the 715° F. lube to match viscosity lowered the yield even further. Thus, stocks higher in viscosity than light neutrals, i.e., greater than about 250 SUS 100° F. are preferred since yield loss is excessive with the lighter stocks using ZSM-5 as the dewaxing catalyst.

What is claimed is:

1. A process for preparing a high quality lube base stock oil in high yield and of improved viscosity index from waxy crude oil, which comprises:

extracting a distillate fraction that boils within the range of 600°–1100° F. or deasphalted short residuum fraction of said waxy crude with a solvent selective for aromatic hydrocarbons to yield a raffinate;

mixing the raffinate with hydrogen and contacting the mixture at a temperature of 500°–675° F. with a dewaxing catalyst comprising an aluminosilicate zeolite having a silica/alumina ratio of at least about 12 and a constraint index of about 1 to about 12, thereby converting wax contained in the raffinate to lower boiling hydrocarbons; and cascading dewaxed raffinate to a hydrotreating zone wherein the dewaxed raffinate is contacted in the presence of hydrogen with a hydrotreating catalyst comprising hydrogenation component on a non-acidic support, hydrotreating at a temperature of about 625°–700° F. and a hydrogen partial pressure of about 200–700 psig so as to partially desulfurize said dewaxed raffinate by about 30–90% with less than about 5 weight percent loss of yield in the lube range.

2. The process described in claim 1 wherein said raffinate is prepared by extraction of said distillate fraction and the total effluent of said catalytic dewaxing step is cascaded to said hydrotreating zone.

3. The process described in claim 1 wherein said raffinate is prepared by extraction of said deasphalted short residuum fraction and the total effluent of said catalytic dewaxing step is cascaded to said hydrotreating zone.

4. The process described in claim 1 wherein said dewaxing step proceeds at a hydrogen partial pressure of 150–1500 psia and at a space velocity of 0.1–2 LHSV.

5. The process described in claim 1 wherein said dewaxing catalyst comprises ZSM-5 and a hydrogenation metal.

6. The process described in claim 2 wherein said dewaxing catalyst comprises ZSM-5 and a hydrogenation metal.

7. The process described in claim 3 wherein said dewaxing catalyst comprises ZSM-5 and a hydrogenation metal.

8. The process described in claim 2 wherein said raffinate is partially dewaxed by solvent dewaxing before said contact with the dewaxing catalyst.

9. The process described in claim 3 wherein said raffinate is partially dewaxed by solvent dewaxing before said contact with said dewaxing catalyst.

10. The process described in claim 2 wherein said hydrotreating catalyst is cobalt-molybdate, nickel-molybdate or nickel-tungsten on alumina.

11. The process described in claim 3 wherein said hydrotreating catalyst is cobalt-molybdate, nickel-molybdate or nickel-tungsten on alumina.

12. The process described in claim 5 wherein said hydrogenation metal is nickel.

13. The process described in claim 6 wherein said hydrogenation metal is nickel.

14. The process described in claim 7 wherein said hydrogenation metal is nickel.

* * * * *